United States Patent [19]

Clauser

[11] Patent Number: 4,781,137

[45] Date of Patent: Nov. 1, 1988

[54] BOOM-FOOTED SAIL EFFICIENCY ENHANCEMENT SYSTEM

[76] Inventor: John F. Clauser, 975 Murrieta Blvd. #22, Livermore, Calif. 94550

[21] Appl. No.: 48,795

[22] Filed: May 12, 1987

Related U.S. Application Data

[63] Continuation-in-part of Ser. No. 730,167, May 3, 1985.

[51] Int. Cl.[4] ..... B63H 9/04

[52] U.S. Cl. ..... 114/102; 114/39.1; 114/364

[58] Field of Search ..... 114/102, 391, 364, 361, 114/103, 105, 89, 93, 97–99, 39.2

[56] References Cited

U.S. PATENT DOCUMENTS

| | | | |
|---|---|---|---|
| 3,598,075 | 8/1971 | Kenney | 114/39.1 |
| 4,365,570 | 12/1982 | Jamieson | 114/39.2 |
| 4,437,426 | 3/1984 | Latham | 114/103 |
| 4,492,175 | 1/1985 | Johnson | 114/361 X |
| 4,702,186 | 10/1987 | Tiede | 114/39.1 |

*Primary Examiner*—Galen Barefoot
*Assistant Examiner*—Paul E. Salmon
*Attorney, Agent, or Firm*—Henry P. Sartorio

[57] ABSTRACT

To prevent crossflow of wind and increase aerodynamic efficiency of boom-footed sail, a stationary sealing vertical baffle structure is mounted along the centerline of a sailboat under the boom. The top portion of the baffle is made of a compliant sealing material, e.g., closed cell polyurethane foam, which forms a tight seal with the boom when the boom is positioned substantially along the centerline, as is common when sailing to weather. The boom and baffle can have curved side surfaces which form with the sail a substantially continuous surface which extends the effective sail area down to the deck.

20 Claims, 2 Drawing Sheets

BOOM-FOOTED SAIL EFFICIENCY ENHANCEMENT SYSTEM

RELATED APPLICATIONS

This application is a continuation-in-part of Ser. No. 730,167 filed May 3, 1985.

BACKGROUND OF THE INVENTION

The invention relates generally to sailboats or racing yachts and more particularly to boom-footed sails.

The speed of a sailboat is related to wind velocity and direction. The mainsail of a sailboat or racing yacht is usually attached to a horizontal boom which swings about the mast with the sail as wind velocity and direction change. The function of the boom is to spread the sail outward, away from the mast. Although this may be accomplished by a sheet (line) simply pulling between the corner of the sail and the deck when the sail is trimmed close to the boat's center line, such a scheme would be ineffective when it is desired to trim the sail at large angles to the center line, as such a line would be required to end outside of the deck. Finally, a boom-footed sail allows the boat to tack with minimal crew attention required for it and is thus a convenience.

Unfortunately, the crossflow of wind through the space between the boom and the deck or cabin reduces the efficiency of the sail. This airflow produces trailing vorticies off the lower end of the sail which increases the induced drag of the sail plan, thereby reducing its propulsive force.

Attempts have been made to improve the performance of boom-footed sails by placing the boom in close proximity to the deck. However, the gain in such attempts is slight since a seal is not maintained. Moreover, the boom's necessary vertical movement would prevent a seal. Also, because the boom swings with great force, the height of the boom must for practical reasons be at some distance above the deck or cabin so that a person standing on the boat will not be hit by the swinging boom.

One solution is to extend the sail below the boom or attach an additional sail to the boom which hangs down from the boom. However this sail would be extremely difficult to operate as the boom shifts positions. In addition, in competitive racing the amount of sail surface is limited or penalized by various rating rules. Anything attached to the boom which moves with the boom would be considered additional sail area. This additional area may be a penalized or an outright violation of tne rules. Such an additional sail is shown, for example, in U.S. Pat. No. 3,598,075 to Kenney which shows a two boom arrangement which provide a two surface sail shaped like an airplane wing. An additional sail or so called "fillet sheet" can be attached to the booms and stretched to the deck.

Some jibs, called "deck-sweepers", have their lower edges (feet) in contact with the deck of a yacht, thereby at least partly sealing the lower edge to the deck. Jib-like sails have sometimes been used in positions where boom-footed sails are ordinarily used, allowing a deck-sweeper configuration. In these cases, the utility of the boom is lost.

OBJECTS OF THE INVENTION

Accordingly, it is an object of the invention to enhance the efficiency of a boom-footed sail.

It is also an object of the invention to improve the aerodynamic properties of a boom-footed sail by preventing crossflow of wind between the boom and deck or cabin.

It is a further object of the invention to improve efficiency and prevent crossflow of wind beneath boom-footed sail without attaching an additional sail or other components to the boom.

It is another object of the invention to maintain a seal between the boom and the deck or cabin over an important range of horizontal and vertical positions of the boom.

It is also an object of the invention to provide unpenalized additional effective sail area between the boom and deck or cabin when the boom is positioned near the centerline of the boat.

It is a also an object of the invention to provide a seal between the boom and deck or cabin when the boat is sailing into the wind.

It is a further object of this invention to incorporate streamlining of the sail to baffle joint by the use of a preferred boom shape.

SUMMARY OF THE INVENTION

The invention is a stationary sealing means fixed to a boat for sealing the space between a boom and the deck that improves the efficiency of a boom-footed sail, for example the mainsail on a sloop rigged sailing yacht. Its application is not limited to this situation and, for example, boom-footed (commonly called club-footed) jibs could profit similarly, as could mizzen sails on a yawl or ketch-rigged sailboat. A streamlined baffle of some thickness is affixed to the fore and aft centerline of the deck of (and/or extending to the sole of a cockpit of) the sailing yacht underneath a boom-footed sail. The top of the baffle is constructed so as to provide a flexible compliant sliding seal against the bottom (and/or sides) of the boom. The compliance of the seal allows the boom to swing vertically or horizontally, yet maintain a seal over a range of positions of the boom. The most important case to maintain the seal is when the boom is roughly centered athwartships, as usually occurs when the yacht is sailing to weather. Vertical movements of the boom that are necessitated by sail-cloth stretch, rigging stretch, reefing, required variations in sail twist, etc. are accommodated by the seal's flexibility and compliance.

The primary purpose of the baffle is to improve the aerodynamic properties of the sail by preventing crossflow of wino between the boom and deck (and/or cockpit). This then strongly inhibits the formation of trailing vorticies off the lower end of the sail, and thereby reduces the consequent induced drag of the sail plan. Since the induced drag of the sail plan represents a major loss in propulsive force, the yacht will point higher into the wind and travel faster.

DETAILED DESCRIPTION OF THE PREFERRED EMBODIMENT

Figure 1:
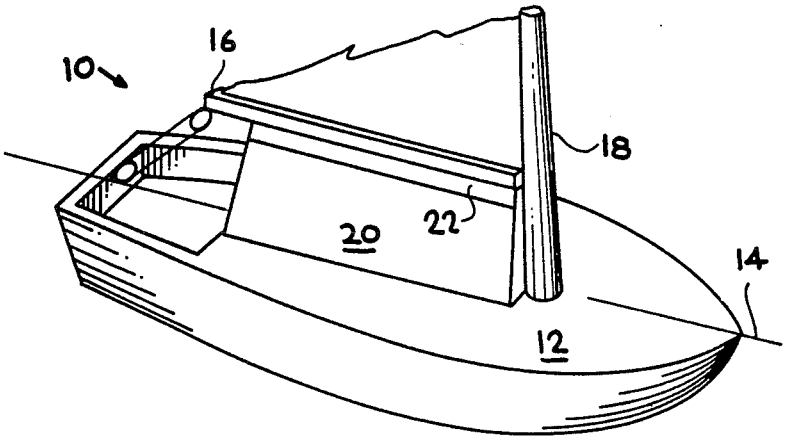
FIG. 1 is a perspective view of a baffle in place on a sailboat.

As shown in FIG. 1 the baffle 10 is mounted on the deck 12 along the centerline 14 of a sailboat. The baffle 10 is mounted so that it extends between the deck 12 and boom 16 behind the mast 18. The baffle 10 includes a lower portion 20 and an upper portion 22 which forms a pliant seal between the lower portion 20 and the boom 16 when boom 16 is positioned approximately along the centerline 14. The upper portion 22 forms a flexible compliant sliding seal against boom 16 and maintains the seal while the boom swings vertically or horizontally over a range of positions. Baffle 10 is of sufficient thickness and height to maintain the seal over this range of boom positions.

It is most important to maintain the seal when the boom is approximately centered athwartships which commonly occurs when the boat is sailing to weather, since it is in this position that the improvement of aerodynamic properties of the sail is most critical. The baffle 10 provides a seal between boom 16 and deck 12 to prevent crossflow of wind underneath the sail.

Figure 2:
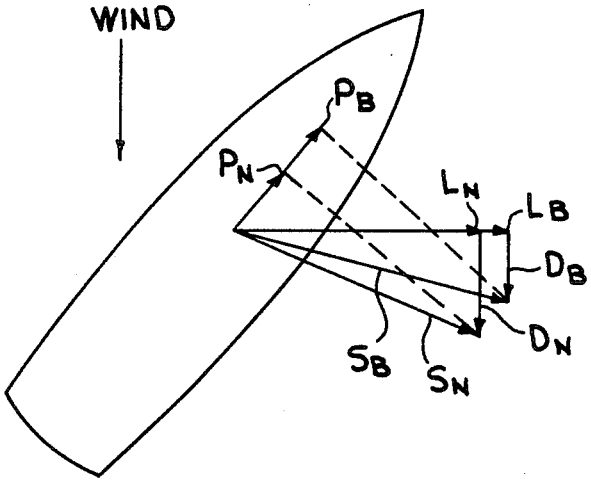
FIG. 2 is a force diagram showing the improvement in propulsive force through use of a baffle when the boat is sailing into the wind.

The forces acting on the sail and the improvements produced by the use of a baffle are illustrated in FIG. 2 for a boat sailing into the wind. The sail lift force vector L is combined with the sail drag force vector D to produce the sail total force S. The component of the sail total force S in the direction of travel of the boat is the sail propulsive force P. In the case without a baffle the sail drag Force $D_N$ (dominantly induced drag) is large so that the sail total force $S_N$ is directed away from the direction of travel of the boat and the sail propulsive force component $P_N$ is relatively small. With the baffle in place the sail lift force $L_B$ is not much greater but the sail drag force $D_B$ is greatly reduced so that the total force $S_B$ is directed more in the direction of travel of the boat. The sail propulsive force component $P_B$ with the baffle is thus greatly increased.

Figure 3:
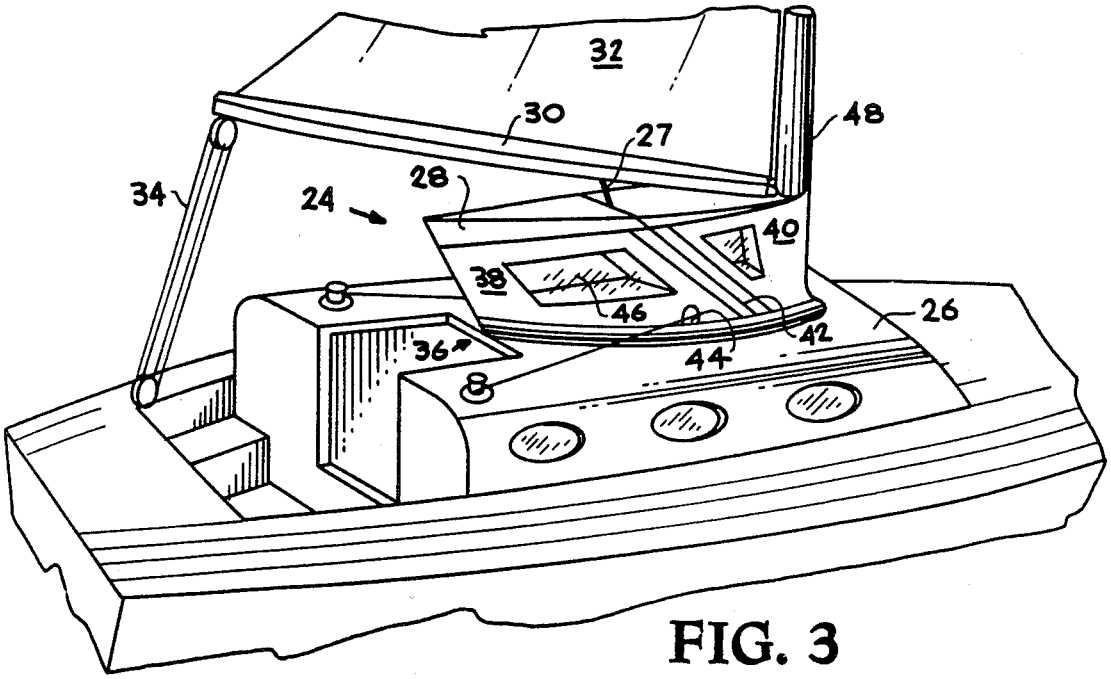
FIG. 3 is a perspective view of an alternate embodiment of a baffle in place on a typical racer/cruiser yacht.

Additional features of the invention are illustrated in the embodiment shown in FIG. 3. Baffle 24 is mounted on deck 26 of a dog house or cabin. Depending on the design of the boat the baffle may be mounted on a deck, on a deck on top of a cabin, or on the sole of a cockpit; the requirement is that the baffle close off and seal as much of the space below the boom as possible or practical. The baffle 24 has a pliant upper portion 28 which forms a seal to boom 30 which is attached to the foot of sail 32. Boom 30 is shown displaced off the centerline and held by line 34 (main-sheet) which is utilized in positioning the boom. When boom 30 swings to a position along the centerline a seal is formed between the boom 30 and upper portion 28 of baffle 24. The lower portion 36 of baffle 24 is made up of a pair of sections 38 and 40 which are mounted to deck 26. The sections 38 and 40 are adjacent with a diagonal transverse slot 42 formed between them which is filled with flexible sealing material so that slot 42 is sealed. The materials used in the upper compliant portion 28 of baffle 24 may be used in slot 42, e.g., flexible polyurethane foam or flexible flaps. The purpose of providing a sealed slot 42 through baffle 24 is to allow boom position controls 27, e.g. sheets or vangs, to pass through the slot from one side of the baffle to the other. The baffle 24 may be made up of several adjacent rigid sections with vertical or diagonal transfer slots formed therein. Each space of such a slot may then have a flexible sealing material affixed to it. Cut outs 44 may be placed in the base of baffle 24 (or elsewhere) to allow passages of lines through the baffle. Windows 46 are formed in the baffle 24; the windows 46 may be covered by a clear plastic or other suitable material which is flush with the surface of baffle 24. Alternatively the baffle may be made from transparent materials.

The baffle may be removably mounted on the boat since its presence at certain times may be obtrusive and unnecessary. The baffle is of greatest interest and value to racing yachtsmen. When the yacht is not being raced the baffle may be removed and stowed below deck or elsewhere. The baffle may be an integral design feature of new yachts or may be retrofitted to existing yachts.

To prevent injury to crew members who may get parts of their bodies caught between the baffle and the boom the compliant parts of the baffle may be made large enough to allow a human body to be so caught without sustaining an injury. Alternatively, the rigid parts of the baffle may be constructed so as to yield when heavy pressure is applied to them thereby also preventing injury to the crew member. When a baffle is constructed of a plurality of adjacent segments individual segments may be knocked out when high pressure is applied to them to avoid accidents.

Baffle 24 shown in FIG. 3 has a streamlined profile to enhance streamlining. The forward end of baffle 24 is faired into the sides of mast 48 to also enhance streamlining.

A trap door may be included either in the baffle itself or in adjacent decking or cockpits to allow crew members to pass through from one side of the yacht to the other.

Figure 4:
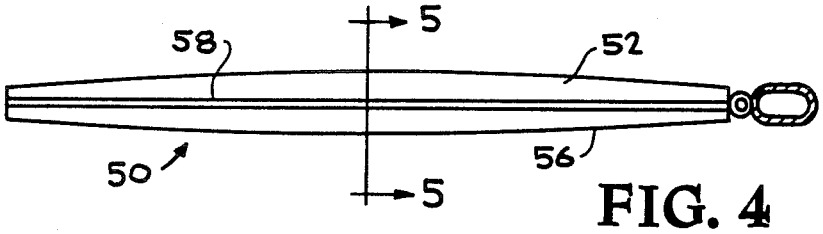
FIG. 4 is a top view of a preferred boom for use with the baffle.
Figure 6:
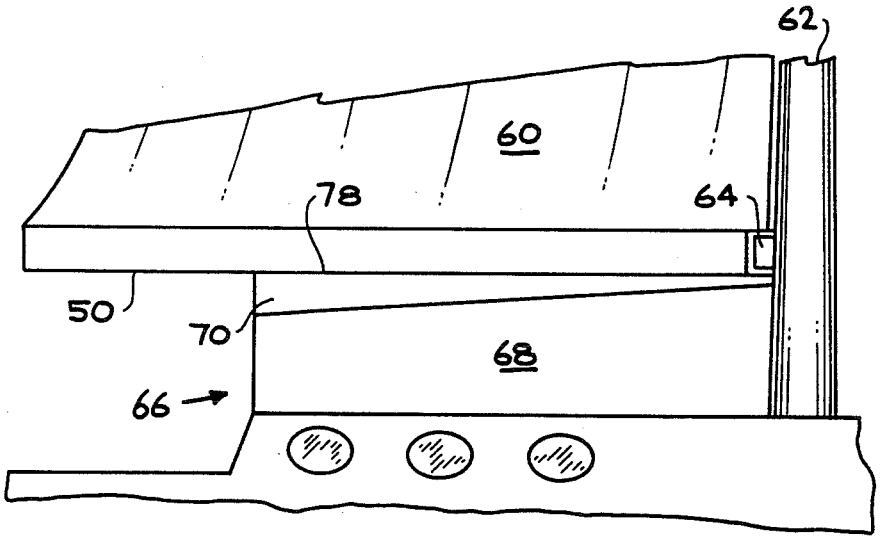
FIG. 6 is a side view of the boom of FIG. 4 with the baffle and sail.
Figure 5:
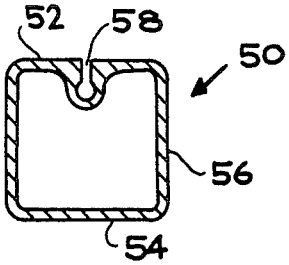
FIG. 5 is a cross-sectional view of the boom of FIG. 4 taken along line 5-5'.

A preferred boom 50 having flat top and bottom faces 52 and 54, respectively, and bowed sides 56 is illustrated in FIGS. 4 and 5. The boom 50 may be used in combination with the baffle according to the invention; however, the baffle may be utilized with any conventional boom. Boom 50 is hollow and has a sail track 58 running down the centerline of the boom's top surface 52. The sail's foot is attached to the boom 50 in the sail track 58. The boom 50 with attached sail 60 is attached to mast 62 by goose neck 64, as illustrated in FIG. 6. The baffle 66 comprising a lower rigid part 68 and upper flexible seal portion 70 is mounted so that the upper portion 70 forms a seal with boom 50 when boom 50 is in the centerline position.

Figure 7:
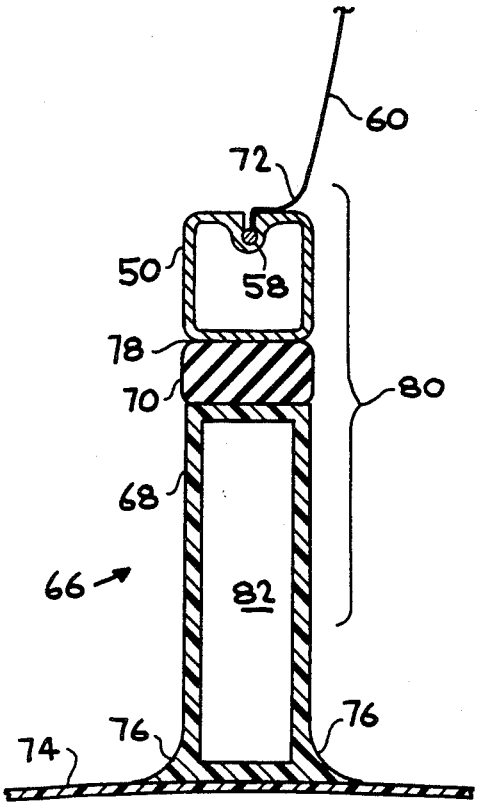
FIG. 7 is a cross-sectional view of the boom, baffle and sail shown in FIG. 6 taken along line 7-7', illustrating the continuous smooth surface formed with the boom approximately on the centerline.

A cross-sectional view of baffle 66, hollow boom 50 and sail 60 is shown in FIG. 7 when boom 50 is in the centerline position. Sail 60 is a "shelf foot" sail having shelf foot 72 which is attached to hollow boom 50 at sail track 58. The lower rigid section 68 of baffle 66 is mounted to deck 74. The base of baffle 66 has suitably radiused fillets 76 where it adjoins deck 74 to enhance streamlining. The upper portion 70 of baffle 66 is made of a flexible seal material and provides a sliding seal face 78 with boom 50. In such a configuration the curved vertical surface of sail 60, the bow of boom 50 and the side of baffle 66 which can also be bowed will form one smooth surface (effective sail area) 80, thus effectively extending the sail's curved leeward side down to deck level.

The rigid lower section of baffle 66 may be hollow, and contain storage compartment 82. Deck gear may be position or stowed inside the baffle 66 in compartment 82 thereby improving the aerodynamic streamlining of the yacht by reducing windage.

The baffles are preferably made partly from rigid materials, e.g., fiberglass, plastic, wood or metal, in order to allow the baffle to maintain its shape under various wind loadings and partly from a flexible compliant material, e.g., closed cell polyurethane foam, to provide a comformable seal on the upper side for various positions of the beam. In a preferred embodiment, the baffle has a rigid lower portion and flexible upper portion. In an alternate embodiment the entire baffle may be made of a flexible compliant material. The flexible top portion of the baffle may also be made from an inflatable bag. The rigid parts of the baffle may be made from a solid material such as Styrofoam or rigid polyurethane foam; the surface of the rigid foam may be strengthened by covering it with a thin layer of fiberglass. Windows may be formed in the baffle and covered by a clear plastic sheet material. The rigid parts of the baffle are preferably hollow, or even collapsible. The rigid parts may then be formed from thin sheet materials, e.g., fiberglass, plastic or cloth, and may be supported by an internal framework; alternatively, the rigid part of the barrier may be self-supporting.

For best efficiency, a good seal between the boom and deck should be provided. The seal should extend in a fore and aft direction as far as practical. Since the most important areas to seal are those near areas with the greatest pressure drop (or desired pressure drop) between opposite sides of the sail, at least the forward half to two-thirds of the length of the boom should be sealed (practical limits may be set by the presence of cockpits, hatch ways, etc..). Thus, the baffle need not fully fill the gap under the boom but should fill as much of the space as possible and provide a good seal for the space that is filled.

when the yacht is beating to weather, i.e., the boom is close to the centerline, the baffle will allow aerodynamic lift to be carried down to deck level. Thus, the baffle itself will act as addition sail area.

However, since the baffle is attached to the deck and not to the boom the baffle will not be classified as additional sail and thus not be restricted by handicapping rules, etc. where the yacht's attitude is that of a broad reach, i.e., the boom is far off the centerline, then air flow over the baffle will probably separate causing some aerodynamic drag. On this point of sail, however, such drag will act as additional propulsive force.

The invention meets the following requirements and includes the following features:

(1) All longitudinal gap(s) between the boom, sail, and deck of the vessel are sealed. A seal is desired with minimum or no residual leakage; a very narrow longitudinal gap is almost as bad as a much wider one.

(2) Conventional soft thin sails are used, as opposed to rigid or thick "wing-sails", with minimal or no modification of the thin sails being required. The sail is self-tacking.

(3) The boom is not lowered to deck level which would interfere with normal deck hardware, especially lifelines, and the mobility of crew members.

(4) The seal is formed and maintained automatically while the boom pivots horizontally at least through the angles of attack of the sail that are important for beating. For mainsails in the downwash of a jib, this range is limited to a small variation about the vessel's centerline, but for vessels with no jib or other sails forward of the boom footed sail, the necessary range will be much larger.

(5) The seal is formed and maintained automatically while the boom pivots through at least the range of angles of vertical pivoting that occur as a result of sail and rigging stretch, required sail twist adjustment, etc. without the vertical pivoting capability of commonly available goosenecks, a boom footed conventional sail would be totally impractical.

(6) Reasonable streamlining is provided, especially on the leeward side of the boom footed sail where flow separation is apt to occur. Any airfoil structures (the baffle) affixed to the deck and thus not trimmable relative to the vessel's centerline must have good streamlining and substantial thickness, e.g. 15–25 % of its length, to resist flow separation on its leeward side. The baffle carries lift all the way down to the deck level. Furthermore, the baffle should preferably be mounted in the downwash of sails forward of the mast (e.g. aft of a deck sweeper jib) so that the net angle of attack of the wind is below the stall angle. The leading edge should be sealed and well streamlined to prevent premature flow separation from propagating aftward along the seal and negating most of its influence.

(7) A minimum or no components are attached to the boom as these might be considered additional sail area which would be penalized, as are excessive boom height (boom depth) and conventional sails carried below the boom.

(8) No additional real trimmable sail area is provided below the boom which would make tacking and gybing awkward.

(9) As much of the boom length as possible and/or practical, given the deck and cockpit layout of the vessel, is sealed. At least the areas of maximum pressure drop across the sail should be sealed, which dominantly occur in the first half to two thirds of the sail's boom length.

(10) The invention is pratical to use while the vessel is actually sailing and unobtrusive to the sailor.

The foregoing is accomplished by affixing a stationary airfoil shaped streamlined baffle to the deck on the fore and aft centerline of a sailing vessel underneath a boom footed sail. The baffle extends from the mast as far aft as possible or practical; it is faired into the leading edge of the mast. It has substantial thickness, about 15–25 % of its length, to limit flow separation on its leeward side. It is preferably used on a vessel rigged with another sail foreward of it, so that the downwash due to this other sail (or sails) will generate a flow over the baffle at but a small angle of attack relative to the vessel's centerline.

The top of the baffle is fitted with a flexible compliant sliding seal that seals the bottom of the boom. The compliance of the seal allows the boom to swing over a range of angles both horizontally and vertically, yet maintain the seal over this range of positions. The seal material can be made of sufficient height, width and compliance to provide a seal over the desired range. The seal is formed and maintained automatically with the motion of the boom. The baffle maintains the seal when the boom is roughly parallel to the vessel's centerline, which is the most important situation for sealing the foot of the sail to the deck. Vertical movements of the boom are accomodated by the seal's flexibility and compliance.

The invention is intended to work with conventional soft thin sails. A preferred boom shape allows streamlining of the sail-to-baffle joint. A seal, conventional or otherwise, is included between the boom and the sail, e.g. by use of a shelf-foot on the sail.

In a preferred embodiment the baffle is formed of a streamlined dinghy removably mounted on the deck. The dinghy is shaped to fit under the boom and is faired into the mast. The dinghy may be in the upright position with a rain cover forming the flexible compliant sliding seal with the boom. By using a dinghy as the baffle two objectives are satisfied and there is no question of compliance with racing rules since a dinghy is always permitted.

Changes and modifications in the specifically described embodiments can be carried out without departing from the scope of the invention which is intended to be limited only by the scope of the appended claims.

I claim:

1. Apparatus for increasing aerodynamic efficiency of a conventional thin sail extending from a mast and attached to a boom that is spaced above a deck of a sailboat when the boom is aligned approximately along the centerline of the boat, and while the boom moves through a normal and substantial range of vertical and horizontal positions about the centerline, comprising:

the sail, boom and mast being configured so that all sail attached to the boom is located above the boom and the sail is self-tacking, and including a seal between the sail and the boom;

a stationary vertical baffle rigidly mounted to the deck and extending from the mast aft along the centerline of the boat for sealing the space between the boom and the deck against air flow therethrough, the baffle including:

a lower portion mounted to the deck; and an upper portion connected to the lower portion that contacts the boom when the boom is aligned approximately along the centerline of the boat, and automatically forms a flexible compliant sliding seal with the boom that is maintained over a range of substantial vertical and horizontal motion of the boom;

the baffle and boom being configured so that the baffle is not attached to the boom, thereby allowing the boom to swing freely above the baffle and be controlled by conventional position controls, the baffle automatically forming a seal with the boom when the boom is positioned approximately along the centerline of the boat and automatically maintaining the seal over a range of horizontal and vertical motion of the boom useful when the boat is sailing to weather, including vertical motion resulting from sail-cloth stretch, rigging stretch, reefing, variations in sail twist, and the like, and automatically breaking the seal when the boom is positioned far from the centerline.

2. The apparatus of claim 1 wherein the baffle is removably mounted to the deck.

3. The apparatus of claim 1 wherein the upper portion is made of flexible foam.

4. The apparatus of claim 1 wherein the lower portion is a rigid structure.

5. The apparatus of claim 1 wherein the baffle has a streamlined shape.

6. The apparatus of claim 5 wherein the baffle has radiused filets at its base and is faired into the deck to enhance streamlining.

7. The apparatus of claim 5 wherein the forward end of the baffle is faired into the leading edge of the mast to enhance streamlining.

8. The apparatus of claim 1 wherein the baffle extends aft from the mast as far as practical as determined by the presence of cockpits, hatchways and other structures.

9. The apparatus of claim 1 wherein the baffle extends aft sufficiently far to seal the areas with the greatest pressure drop between opposite sides of the sail.

10. The apparatus of claim 1 wherein the lower portion is a streamlined removable dinghy.

11. The apparatus of claim 10 wherein the upper portion is a rain cover for the dinghy.

12. Method for increasing aerodynamic efficiency of a conventional thin sail extending from a mast and attached to a boom that is spaced over a deck on a sailboat when the boom is aligned approximately along the centerline of the boat, comprising:

configuring the sail and the boom so that all sail attached to the boom is located above the boom and the sail is self-tacking, including forming a seal between the sail and the boom;

rigidly mounting a stationary baffle to the deck of the sailboat extending from the mast aft to seal the space between the boom and the deck without attaching the baffle to the boom to prevent cross-flow of wind therethrough;

automatically forming a compliant sliding seal between the baffle and boom when the boom is positioned approximately along the centerline of the boat;

automatically maintaining the compliant sliding seal over a range of horizontal and vertical motion of the boom about the centerline, particularly when the boat is sailing to weather, and including vertical motion resulting from sail-cloth stretch, rigging stretch, reefing, variations in sail twist, and the like, and automatically breaking the seal when the boom is far from the centerline.

13. The method of claim 12 further including streamlining the baffle.

14. The method of claim 13 further including fairing the baffle into the leading edge of the mast and into the deck.

15. The method of claim 12 further including forming the baffle of a rigid lower portion and a flexible upper portion.

16. The method of claim 12 further including forming the baffle of a streamlined dinghy.

17. The method of claim 15 further including forming the lower portion of a streamlined dinghy and the upper portion of a rain cover.

18. The method of claim 12 further including extending the baffle aft from the mast as far as practical as determined by the presence of cockpits, hatchways and other structures.

19. The method of claim 12 further including extending the baffle aft sufficiently far to seal the areas with the greatest pressure drop between opposite sides of the sail.

20. The method of claim 12 further including removably mounting the baffle to the deck.

* * * * *